US005811380A

United States Patent [19]

Weitz

[11] Patent Number: 5,811,380

[45] Date of Patent: Sep. 22, 1998

[54] CLEANER, PRESERVATIVE AND ANTIOXIDANT COMPOSITIONS

[75] Inventor: Gene C. Weitz, Palm Harbor, Fla.

[73] Assignee: Rainbow Technology Corporation, Palham, Ala.

[21] Appl. No.: 584,476

[22] Filed: Jan. 11, 1996

[51] Int. Cl.[6] ..... C11D 3/44; C11D 3/43

[52] U.S. Cl. ..... 510/175; 510/407; 508/591; 134/40; 134/42

[58] Field of Search ..... 510/175, 407; 508/591; 134/40, 42

[56] References Cited

U.S. PATENT DOCUMENTS

| | | | |
|---|---|---|---|
| 3,795,623 | 3/1974 | Gagnon | 510/407 |
| 3,819,523 | 6/1974 | Bove | 510/407 |
| 4,162,985 | 7/1979 | Holubec | 508/591 |
| 4,620,937 | 11/1986 | Dellutri | 252/143 |
| 4,640,719 | 2/1987 | Hayes et al. | 134/40 |
| 4,655,966 | 4/1987 | Guillaumon et al. | 252/518 |
| 4,704,225 | 11/1987 | Stoufer | 252/153 |
| 4,783,226 | 11/1988 | Senn | 156/48 |
| 4,867,800 | 9/1989 | Dishart et al. | 510/175 |
| 5,011,620 | 4/1991 | Dishart et al. | 510/175 |
| 5,011,621 | 4/1991 | Sullivan | 252/162 |
| 5,031,648 | 7/1991 | Lutener et al. | 134/32 |
| 5,041,235 | 8/1991 | Kilbarger | 510/407 |
| 5,045,119 | 9/1991 | Dohner | 134/22.11 |
| 5,062,988 | 11/1991 | Dishart et al. | 510/175 |
| 5,084,200 | 1/1992 | Dishart et al. | 510/175 |
| 5,112,516 | 5/1992 | Koetzle | 252/162 |
| 5,146,938 | 9/1992 | Lutener et al. | 134/32 |
| 5,196,136 | 3/1993 | Dishart et al. | 510/175 |
| 5,204,016 | 4/1993 | Hamilton et al. | 252/162 |
| 5,205,955 | 4/1993 | Bunczk et al. | 252/102 |
| 5,213,624 | 5/1993 | Williams | 134/40 |
| 5,238,504 | 8/1993 | Henry | 510/175 |
| 5,336,428 | 8/1994 | Kaplan et al. | 252/162 |
| 5,338,368 | 8/1994 | Fletcher et al. | 134/40 |
| 5,393,451 | 2/1995 | Koetzle | 252/170 |
| 5,405,547 | 4/1995 | Rinehart | 510/175 |
| 5,554,312 | 9/1996 | Ward | 510/175 |
| 5,602,085 | 2/1997 | Peterson et al. | 508/591 |
| 5,602,086 | 2/1997 | Le et al. | 508/591 |
| 5,609,678 | 3/1997 | Bergman | 510/407 |
| B1 4,511,488 | 9/1990 | Matta | 252/162 |
| B1 4,640,719 | 4/1993 | Hayes et al. | 134/40 |

OTHER PUBLICATIONS

Smalheer et al, Lubricant Additives, pp. 1–11, 1967.

*Primary Examiner*—Ellen M. McAvoy
*Attorney, Agent, or Firm*—Joseph C. Mason, Jr.

[57] ABSTRACT

A water insoluble cleaning composition for cleaning insulated telecommunication cables comprising a solvent, a preservative oil and an antioxidant. The cleaning compositions of the present invention are useful for removing filling media from insulated telecommunication cables while simultaneously maintaining the Oxidative Induction Time of the cable. The Oxidative Induction Time of the cable treated with the inventive compositions remains substantially the same as untreated, intact cable in which the filling media has not been removed. A method of using the inventive compositions for the cleaning of telecommunication cables is also disclosed.

8 Claims, 1 Drawing Sheet

CLEANER, PRESERVATIVE AND ANTIOXIDANT COMPOSITIONS

BACKGROUND OF THE INVENTION

1. Field of the Invention

This invention relates, generally, to water insoluble cleaners having preservative and antioxidant properties for use in cleaning insulated telecommunication cables.

2. Description of the Prior Art

The cleaning of insulated telecommunication cables, has proven particularly troublesome in the telecommunication industry. Telecommunication cables are customarily made up of one or more conductors which are surrounded by an insulating material. The one or more insulated conductors are then surrounded by a protective sheath. The voids or interstices between and around the insulating material inside the protective sheath are filled with a waterproof filling medium. The waterproof filling medium can be made of any number of materials, but typically contains hydrocarbon oils, gelling agents and other components. The waterproof filling medium contacts the insulation and acts as a waterproofing agent. Filling media adhere tenaciously to insulation and require repeated mechanical wiping away from the insulation to prepare individual insulated wires for jointing and terminating purposes.

The telecommunication industry has traditionally used solvent based cleaning agents to remove filling media, traces of dirt and moisture from electric cable and other equipment. For example, U.S. Pat. No. 5,238,504 to Henry proposes the use of a blend of terpene hydrocarbons and aliphatic or cyclic ketones for use as effective cleaners. U.S. Pat. No. 5,405,547 to Rinehart discloses a combination of diacetone alcohol and a compatible terpene fraction for use as cleaning and drying compositions. U.S. Pat. No. B1 4,411,488 to Matta discloses a combination of a terpene, surfactant and coupling agent for use as a cleaning composition. U.S. Pat. No. 4,867,800 to Dishart et al. discloses cleaning compositions which include a terpene compound and a dibasic ester for removing residues on the surface of a substrate.

These cleaning compositions provide contact surfaces which are free of filling media and other residual contaminates. However, these prior art cleaners significantly decrease the Oxidative Induction Time (OIT) of the cable. The determination of the Oxidative Induction Time of insulated telecommunication cable is a means for determining the level of stabilization of the cable and cable components. The Oxidative Induction Time is correlated to the suitability of the cable or cable component to withstand the rigors imposed by field service conditions. A decrease in the Oxidative Induction Time indicates that the cable or cable components are susceptible to oxidation. During installation and splicing operations cable components can be exposed to the atmosphere for extended periods of time which can result in extensive oxidation. In addition, some service applications require cable components to be exposed to the atmosphere throughout their useful life. Over time the oxidation of the cable components, can result in corrosion which eventually necessitates the replacement of the affected cable.

In order to maintain the Oxidative Induction Time of the cable after cleaning with conventional cleaners, the filling media, must be replaced after the splicing operation is complete. One approach for replacing the filling media is reapplication by the technician. However, this approach is not practical in the field since these filling media are very messy and tacky, making them difficult to handle.

Another approach is that disclosed in U.S. Pat. No. 4,783,226 to Senn which provides an apparatus which is used to pump a filling medium through a sealed off portion of cable. This approach is both costly and time consuming and necessitates additional equipment to complete the cable installation.

Thus, there remains a need for water insoluble cleaning compositions that not only adequately remove the filling media, but also maintain the Oxidative Induction Time of the cable so that the cable is not rendered susceptible to oxidation. However, at the time the present invention was made, it was not obvious to those of ordinary skill in this art how this need could be fulfilled, in view of the prior art as a whole.

SUMMARY OF THE INVENTION

The long-standing but heretofore unfulfilled need for water insoluble cleaners for cleaning insulated telecommunication cables which maintain the Oxidative Induction Time of the cable is now fulfilled by a cleaning composition that includes a solvent, a preservative oil and an antioxidant. Solvents useful in the present invention include aliphatic solvents, aromatic solvents, terpene hydrocarbons, aliphatic or cyclic ketones, ester solvents and chlorinated solvents. The solvent portion of the cleaning compositions of the present invention can be a combination of one or more aliphatic solvents, aromatic solvents, terpene hydrocarbons, aliphatic or cyclic ketones, ester solvents and chlorinated solvents.

Aliphatic solvents useful in the present invention include petroleum distillates, white spirit, gasolines, kerosene, mineral spirits and dearomatized mineral spirits having from eight to fourteen carbon atoms. In particular, petroleum distillates useful in the present invention include n-octane, n-nonane, n-decane, n-undecane, n-dodecane and n-tetradecane.

Aromatic solvents used in the present invention are $C_1$–$C_8$ alkyl derivatives of benzene and naphthalene. Naphthalene-depleted aromatic petroleum distillates are also useful in the present invention. For example toluene, xylene, cumene, ethylbenzene, ethylmethylbenzene, meisitylene and durene are useful in the present invention.

Terpene hydrocarbons useful in the present invention include dipentene, alpha-pinene, beta-pinene, nonal, octanal, para-menthadiene, para-cymene, limonene, cedrene, turpentine, 2-methly-6-methylene-2,7-octadiene,2,6-dimethyl-2,4,6-octadiene, and the like, and mixtures thereof.

Aliphatic or cyclic ketones useful in the present invention include acetone, methyl ethyl ketone, methyl propyl ketone, methyl isobutyl ketone, mesityl oxide, methyl isoamyl ketone, diacetone alcohol, methyl amyl ketone, cyclohexane, diisobutyl ketone, isophorone, cyclohexanone, ethyl butyl ketone, acetophenone, cyclopentanone, and the like, and mixtures thereof.

Ester solvents useful in the present invention include ethyl acetate, isopropyl acetate, n-propyl acetate, isobutyl acetate, n-butyl acetate, amyl acetate, isobutyl isobutyrate, 2-ethylhexyl acetate, vinyl acetate, sec-butyl acetate, butyrolactone, cyclohexyl acetate, amyl propionate, ethylene glycol monoacetate, ethylene glycol diacetate, methyl benzoate, phenyl acetate, and the like, and mixtures therof.

Cholorinated solvents useful in the present invention include methylene chloride, chloroform, 1,1,1-trichlorethane, carbon tetrachloride, ethylene dichloride, trichlorethylene, propylene dichloride, perchlorethylene, monochlorbenzene, dichlorobenzene, and the like, and mixtures thereof.

Preservative oils used in the present invention include polybutene oil and mineral oil. Antioxidants useful in the present invention include 3,4-dihydro-2-methyl-2-(4,8,12-trimethyltridecyl)-2H-1-benzopyran-6-ol, 2-methyl-2-(4,8,12-trimethyltridecyl)-6-chromanol, thio-diethylene-bis-(3,5,-di-tert-butyl-4-hydroxyhydrocinnamate), 2-methyl-2-phytyl-6-chromanol, 6-hydroxy-2-methyl-2-phytylchroman and 2-methyl-2-phytyl-6-hydroxychroman.

A method of cleaning and preserving insulated telecommunication cables which comprises applying a water insoluble cleaning formulation to a cable to be cleaned, said water insoluble cleaning formulation comprising a solvent, a preservative oil and an antioxidant and allowing the cable to dry whereby the Oxidation Induction Rate of the cable is essentially the same as that prior to cleaning, is also disclosed.

Thus it is understood that a primary object of this invention is to advance the art of insulated telecommunication cable cleaners by providing a water insoluble cleaner which does not decrease the Oxidative Induction Time of the cable or cable components.

This and other important objects, features and advantages of the invention will become apparent as this description proceeds.

The invention accordingly comprises the features of water insoluble cleaning compositions for cleaning insulated telecommunication cables which maintain the Oxidative Induction Time of the cable components that will be exemplified in the description hereinafter set forth, and the scope of the invention will be indicated in the claims.

DETAILED DESCRIPTION OF THE PREFERRED EMBODIMENT

Figure 1:
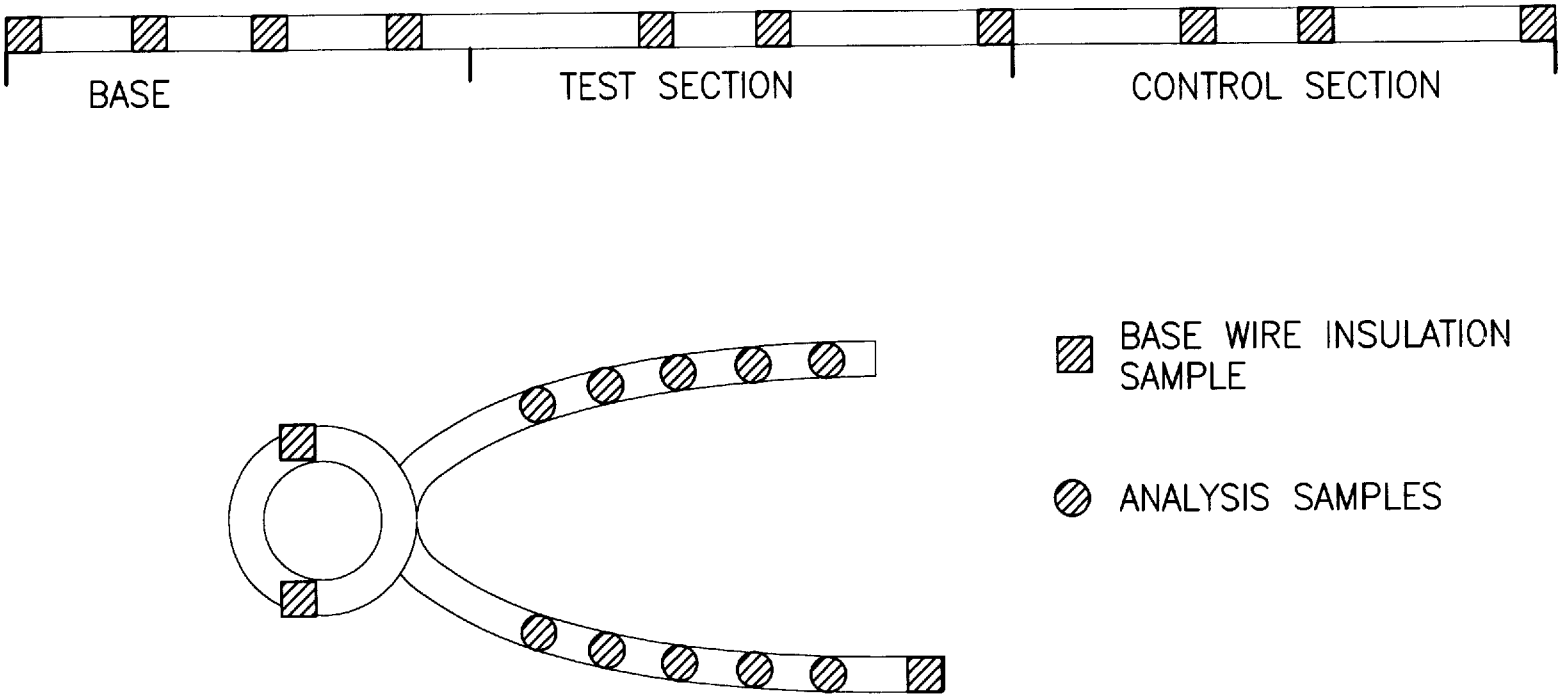
FIG. 1 depicts one embodiment of the invention showing a base section, a test section and a control section.

The present invention is directed to water insoluble cleaning compositions, having preservative and antioxidant properties for use in cleaning and preserving insulated telecommunication cable. The water insoluble cleaners of the present invention include a solvent, a preservative oil and an antioxidant. In a preferred embodiment, the present invention is directed to a cleaning composition which includes from 80 to 98.45 percent by weight solvent, from 0.5 to 20 percent by weight preservative oil and from 0.05 to 1.0 percent by weight antioxidant. In a more preferred embodiment, the composition includes from 80 to 98.45 percent by weight solvent, from 2.0 to 8.0 percent by weight preservative oil and from 0.09 to 0.9 percent by weight antioxidant. In a most preferred embodiment, the composition includes 94 percent by weight solvent, 5.88 percent by weight preservative oil and 0.12 percent by weight antioxidant.

The cleaning compositions of the present invention are effective, in general, for removing filling media and displacing water or moisture as well as maintaining the Oxidative Induction Time of the cable. The cleaning compositions of the present invention, are effective at inhibiting oxidation of cable components. The Oxidative Induction Time of the cable or cable components cleaned with the inventive compositions are not significantly reduced and remain substantially the same as untreated, intact cable in which the filling media has not been removed.

The solvent portion of the cleaning compositions of the present invention can be a combination of one or more aliphatic solvents, aromatic solvents, terpene hydrocarbons, aliphatic or cyclic ketones, ester solvents and chlorinated solvents. In particular, aliphatic solvents useful in the preparing the compositions of the present invention include aliphatic petroleum solvents such as petroleum distillates, white spirit, gasolines, kerosene, mineral spirits, and dearomatized mineral spirits having from eight to fourteen carbon atoms. For purposes of the present invention, petroleum distillates are generally defined as a highly complex mixture of aliphatic paraffinic and cycloparaffinic (naphthenic) hydrocarbons derived from cracked or distilled petroleum. Such mixtures include a mixture of any of naphtha of several grades, gasoline, kerosene, fuel oils, gas oil, lubricating oils, paraffin wax and asphalt. For example, aliphatic solvents include compounds having from eight to fourteen carbon atoms. Aliphatic solvents such as n-octane, n-nonane, n-decane, n-undecane, n-dodecane and tetradecane are suitable for use in the present invention. In particular, suitable solvents useful in the present invention include aliphatic solvents having a flash point from 140° F. to 190° F. The aliphatic solvents useful in the present invention preferably have a flash point of 170° F. Other suitable petroleum distillates useful in the present invention, are known in the art, such as for example, those described in CAS# (Chemical Abstracts Service) No. 64742-47-8.

Aromatic solvents useful in the present composition include $C_1$–$C_8$ alkyl derivatives of benzene and naphthalene, such as toluene, xylene, cumene, ethylbenzene, ethylmethylbenzene, meisitylene, durene and the like and mixtures thereof. Naphthalene-depleted aromatic petroleum distillates are also useful in the present invention.

Other specific commercially available aliphatic and aromatic solvents suitable for use in the present invention, are known in the art, such as for example, those described in *Industrial Solvents,* 3rd Ed., E. W. Flick, Ed., Noyes Data Corp. (1985), pp. 57–83.

The terpene hydrocarbons useful in the present invention include dipentene, alpha-pinene, beta-pinene, nonal, octanal, para-menthadiene, para-cymene, limonene, cedrene, turpentine, 2-methly-6-methylene-2,7-octadiene, 2,6-dimethyl-2,4,6-octadiene, and the like, and mixtures thereof.

The aliphatic or cyclic ketones useful in the present invention include acetone, methyl ethyl ketone, methyl propyl ketone, methyl isobutyl ketone, mesityl oxide, methyl isoamyl ketone, diacetone alcohol, methyl amyl ketone, cyclohexane, diisobutyl ketone, isophorone, cyclohexanone, ethyl butyl ketone, acetophenone, cyclopentanone, and the like, and mixtures thereof.

The ester solvents useful in the present invention include ethyl acetate, isopropyl acetate, n-propyl acetate, isobutyl acetate, n-butyl acetate, amyl acetate, isobutyl isobutyrate, 2-ethylhexyl acetate, vinyl acetate, sec-butyl acetate, butyrolactone, cyclohexyl acetate, amyl propionate, ethylene glycol monoacetate, ethylene glycol diacetate, methyl benzoate, phenyl acetate, and the like, and mixtures therof.

The cholorinated solvents useful in the present invention include methylene chloride, chloroform, 1,1,1-trichlorethane, carbon tetrachloride, ethylene dichloride, trichlorethylene, propylene dichloride, perchlorethylene, monochlorbenzene, dichlorobenzene, and the like, and mixtures thereof.

The more preferred solvents are those which are non-flammable, i.e., have flash points above 140° F. and up to 250° F. From an environmental and safety view, the preferred solvents include solvents with flash points of 150° F.

or above. Further, the solvents used in the present invention are preferably liquids at ambient temperature.

The preservative oils useful in the present cleaning compositions include nonvolatile high molecular weight oils such as polybutene oil and mineral oil. However, any commercially available oil is suitable, and any mixture of oils may be employed. Of primary importance is usually the cost of the oil. The most preferred oils are the ones that are most readily available in sufficient quantity and are the least expensive. Further examples of useful oils that may be employed in the compositions of the present invention are known in the art, such as for example, those described in Kirk-Othmer, *Encyclopedia of Chemical Technology,* 3rd. Ed., Vol. 9, pp. 795–830.

Antioxidants such as 3,4-dihydro-2-methyl-2-(4,8,12-trimethyltridecyl)-2H-1-benzopyran-6-ol, 2-methyl-2-(4,8,12-trimethyltridecyl)-6-chromanol, thio-diethylene-bis-(3,5-di-tert-butyl-4-hydroxyhydrocinnamate), 2-methyl-2-phytyl-6-chromanol, 6-hydroxy-2-methyl-2-phytylchroman and 2-methyl-2-phytyl-6-hydroxychroman are useful in the present invention.

The cleaning compositions of the present invention are prepared by simply combining all of the organic components thereof in a suitable vessel or container with sufficient agitation. The order of mixing the organic components is not particularly important and generally the various organic materials are added sequentially. Preferably, the compositions of the present invention are prepared by mixing the organic components until the mixture is homogeneous. Those skilled in the art can readily determine the order of mixing given the dissolution properties and solubility of the particular components used in the inventive composition. Typically, good manufacturing procedures involve adding the largest (in amount) component first, and adding the most volatile component last. Preferably, the pH of the composition is from 6 to 9 for cleaning applications.

The cleaning compositions of the present invention can be used in a wide variety of methods which will vary according to the amount of filling media to be removed and the size and shape of the article to be cleaned. The cleaning compositions can be applied, for example, by brushing, spraying, immersion dipping, hosing and wiping. The cleaning compositions of the present invention can be used at temperatures ranging from −30° F. up to 160° F. Contact times of the article with the cleaning composition are usually for from one minute to five minutes, and preferably for three minutes. After the contact time any contaminated cleaner is removed from the article by rinsing with additional cleaner. The article is allowed to air dry which facilitates the evaporation of the volatile components of the cleaner while the nonvolatile protective conponents remain on the article. After the volatile components have evaporated, the insulated telecommunication is ready for use in operations such as installation and splicing. The inventive cleaner leaves a residual film on the cable or cable components which protects the cable from the oxidative effects of the atmosphere. The residual film, however, does not interfere with installation and splicing operations. The Oxidative Induction Time of the cable is thereby maintained after cleaning with the present compositions. Specifically, the Oxidative Induction Time of the cable or cable components cleaned with the inventive compositions are not significantly reduced and remain substantially the same as untreated intact cable in which the filling media has not been removed.

EXAMPLES

The following examples are presented to illustrate the invention, which are not intended to be in any way limited thereto, since numerous modifications and variations therein will be apparent to one skilled in the art.

Example 1

A water insoluble cleaning composition for cleaning insulated electric supply cables may be prepared by combining and mixing the following ingredients:

| Ingredient | % by Weight |
|---|---|
| n-Decane | 80 |
| Ethylmethylbenzene | 15 |
| Polybutene Oil | 4.9 |
| 2-methyl-2-phytyl-6-hydroxychroman | 0.1 |

The combination will be clear and stable. It is anticipated that when the composition is tested it will exhibit a flash point in excess of 140° F. It is expected that the Oxidative Induction Time of the cable or cable components cleaned with the above composition will not be significantly reduced and will remain substantially the same as untreated cable.

Example 2

A water insoluble cleaning composition of the present invention may be prepared by combining and mixing the following ingredients:

| Ingredient | % by Weight |
|---|---|
| Limonene | 80 |
| Methyl ethyl ketone | 15 |
| Mineral Oil | 4.9 |
| thio-diethylene-bis-(3,5-di-tert-butyl-hydroxyhydrocinnamate) | 0.1 |

The combination will be clear and stable. It is anticipated that when the composition is tested it will exhibit a flash point in excess of 140° F. It is expected that the Oxidative Induction Time of the cable or cable components cleaned with the above composition will not be significantly reduced and will remain substantially the same as untreated cable.

Example 3

A water insoluble cleaning composition of the present invention may be prepared by combining and mixing the following ingredients:

| Ingredient | % by Weight |
|---|---|
| Isobutyl acetate | 80 |
| 1,1,1-Trichloroethane | 15 |
| Mineral Oil | 4.9 |
| 2-methyl-2-phytyl-6-hydroxychroman | 0.1 |

The combination will be clear and stable. It is anticipated that when the composition is tested it will exhibit a flash point in excess of 140° F. It is expected that the Oxidative Induction Time of the cable or cable components cleaned with the above composition will not be significantly reduced and will remain substantially the same as untreated cable.

Example 4

A water insoluble cleaning composition of the present invention may be prepared by combining and mixing the following ingredients:

| Ingredient | % by Weight |
|---|---|
| Methyl chloride | 80 |
| Naphthalene-depleted aromatic petroleum distillate | 15 |
| Polybutene Oil | 4.9 |
| thio-dielhylene-bis-(3,5-di-tert-butyl-4-hydroxyhydrocinnamate) | 0.1 |

The combination will be clear and stable. It is anticipated that when the composition is tested it will exhibit a flash point in excess of 140° F. It is expected that the Oxidative Induction Time of the cable or cable components cleaned with the above composition will not be significantly reduced and will remain substantially the same as untreated cable.

Example 5

A water insoluble cleaning composition of the present invention may be prepared by combining and mixing the following ingredients:

| Ingredient | % by Weight |
|---|---|
| n-Dodecane | 80 |
| Ethylmethylbenzene | 15 |
| Mineral Oil | 4.9 |
| thio-dielhylene-bis-(3,5-di-tert-butyl-4-hydroxyhydrocinnamate) | 0.1 |

The combination will be clear and stable. It is anticipated that when the composition is tested it will exhibit a flash point in excess of 140° F. It is expected that the Oxidative Induction Time of the cable or cable components cleaned with the above composition will not be significantly reduced and will remain substantially the same as untreated cable.

Example 6

A water insoluble cleaning composition of the present invention may be prepared by combining and mixing the following ingredients:

| Ingredient | % by Weight |
|---|---|
| Dearomatized mineral spirits | 30 |
| Naphthalene-depleted aromatic petroleum distillate | 59 |
| Polybutene Oil | 10 |
| thio-dielhylene-bis-(3,5-di-tert-butyl-4-hydroxyhydrocinnamate) | 1.0 |

The combination will be clear and stable. It is anticipated that when the composition is tested it will exhibit a flash point in excess of 140° F. It is expected that the Oxidative Induction Time of the cable or cable components cleaned with the above composition will not be significantly reduced and will remain substantially the same as untreated cable.

Example 7

A water insoluble cleaning composition of the present invention may be prepared by combining and mixing the following ingredients:

| Ingredient | % by Weight |
|---|---|
| n-Decane | 30 |
| Ethylmethylbenzene | 59 |
| Polybutene Oil | 10 |
| thio-diethylene-bis-(3,5-di-tert-butyl-hydroxyhydrocinnamate) | 1.0 |

The combination will be clear and stable. It is anticipated that when the composition is tested it will exhibit a flash point in excess of 140° F. It is expected that the Oxidative Induction Time of the cable or cable components cleaned with the above composition will not be significantly reduced and will remain substantially the same as untreated cable.

Example 8

A water insoluble cleaning composition of the present invention may be prepared by combining and mixing the following ingredients:

| Ingredient | % by Weight |
|---|---|
| Dearomatized mineral spirits | 70.5 |
| Naphthalene-depleted aromatic petroleum distillate | 23.5 |
| Polybutene Oil | 5.88 |
| thio-dielhylene-bis-(3,5-di-tert-butyl-4-hydroxyhydrocinnamate) | 0.12 |

The combination will be clear and stable. It is anticipated that when the composition is tested it will exhibit a flash point in excess of 140° F. It is expected that the Oxidative Induction Time of the cable or cable components cleaned with the above composition will not be significantly reduced and will remain substantially the same as untreated cable.

Example 9

A water insoluble cleaning composition of the present invention may be prepared by combining and mixing the following ingredients:

| Ingredient | % by Weight |
|---|---|
| n-Decane | 98.45 |
| Ethylmethylbenzene | 1.0 |
| Polybutene Oil | 0.5 |
| 2-methyl-2-phytyl-6-hydroxychroman | 0.05 |

The combination will be clear and stable. It is anticipated that when the composition is tested it will exhibit a flash point in excess of 140° F. It is expected that the Oxidative Induction Time of the cable or cable components cleaned with the above composition will not be significantly reduced and will remain substantially the same as untreated cable.

Example 10

A water insoluble cleaning composition of the present invention may be prepared by combining and mixing the following ingredients:

| Ingredient | % by Weight |
|---|---|
| n-Decane | 87.91 |
| Ethylmethylbenzene | 10 |
| Polybutene Oil | 2.0 |
| 2-methyl-2-phytyl-6-hydroxychroman | 0.09 |

The combination will be clear and stable. It is anticipated that when the composition is tested it will exhibit a flash point in excess of 140° F. It is expected that the Oxidative Induction Time of the cable or cable components cleaned with the above composition will not be significantly reduced and will remain substantially the same as untreated cable.

Example 11

A water insoluble cleaning composition of the present invention may be prepared by combining and mixing the following ingredients:

| Ingredient | % by Weight |
|---|---|
| Dearomatized mineral spirits | 50 |
| Naphthalene-depleted aromatic petroleum distillate | 41.1 |
| Polybutene Oil | 8.0 |
| thio-dielhylene-bis-(3,5-di-tert-butyl-4-hydroxyhydrocinnamate) | 0.9 |

The combination will be clear and stable. It is anticipated that when the composition is tested it will exhibit a flash point in excess of 140° F. It is expected that the Oxidative Induction Time of the cable or cable components cleaned with the above composition will not be significantly reduced and will remain substantially the same as untreated cable.

Example 12

A water insoluble cleaning composition of the present invention may be prepared by combining and mixing the following ingredients:

| Ingredient | % by Weight |
|---|---|
| n-Dodecane | 50 |
| Ethylmethylbenzene | 41.1 |
| Polybutene Oil | 8.0 |
| 2-methyl-2-phytyl-6-hydroxychroman | 0.9 |

The combination will be clear and stable. It is anticipated that when the composition is tested it will exhibit a flash point in excess of 140° F. It is expected that the Oxidative Induction Time of the cable or cable components cleaned with the above composition will not be significantly reduced and will remain substantially the same as untreated cable.

Example 13

A water insoluble cleaning composition of the present invention may be prepared by combining and mixing the following ingredients:

| Ingredient | % by Weight |
|---|---|
| Dearomatized mineral spirits | 87.91 |
| Naphthalene-depleted aromatic petroleum distillate | 10 |
| Polybutene Oil | 2.0 |
| thio-dielhylene-bis-(3,5-di-tert-butyl-4-hydroxyhydrocinnamate) | 0.09 |

The combination will be clear and stable. It is anticipated that when the composition is tested it will exhibit a flash point in excess of 140° F. It is expected that the Oxidative Induction Time of the cable or cable components cleaned with the above composition will not be significantly reduced and will remain substantially the same as untreated cable.

Example 14

A water insoluble cleaning composition of the present invention may be prepared by combining and mixing the following ingredients:

| Ingredient | % by Weight |
|---|---|
| n-Dodecane | 50 |
| Ethylmethylbenzene | 43 |
| Polybutene Oil | 6.5 |
| 2-methyl-2-phytyl-6-hydroxychroman | 0.5 |

The combination will be clear and stable. It is anticipated that when the composition is tested it will exhibit a flash point in excess of 140° F. It is expected that the Oxidative Induction Time of the cable or cable components cleaned with the above composition will not be significantly reduced and will remain substantially the same as untreated cable.

Example 15

A water insoluble cleaning composition of the present invention may be prepared by combining and mixing the following ingredients:

| Ingredient | % by Weight |
|---|---|
| n-Undecane | 80 |
| Ethylmethylbenzene | 15 |
| Mineral Oil | 4.9 |
| 2-methyl-2-(4,8,12-trimethyltridecyl-6-chromanol) | 0.1 |

The combination will be clear and stable. It is anticipated that when the composition is tested it will exhibit a flash point in excess of 140° F. It is expected that the Oxidative Induction Time of the cable or cable components cleaned with the above composition will not be significantly reduced and will remain substantially the same as untreated cable.

Comparative Example

The inventive water insoluble cleaning compositions can be tested to determine their effects on the Oxidation Induction Time (OIT) of cable or cable components. The cable or cable component stability can be rated by an OIT value derived by using the method in Bellcore Technical Reference 421. Specifically, filled cable can be used in the test. Cable components can be used in the "as removed from the cable" state rather than pre-aging to reduce the original OIT value. Alternatively, pre-aging can be performed by preconditioning a length of cable with both ends sealed with vinyl tape or a cap in a ASTM Type IIB oven in accordance with the procedures outlined in ASTM E 145 at 70° C. (158° F.) for two weeks. Cable or cable components can be tested by measuring the OIT (Oxidative Induction Time) in accordance with the procedures outlined in ASTM D 4565, Section 17, subject to any modifications which may be deemed necessary by those skilled in the art. The test method would include insulation stripped from the wire. Specifically the cable would be wiped with a towel wetted with the appropriate cleaner, components would be either an inventive cleaner or a conventional cleaner, until the filling media is removed. The cable components will not be wiped dry. Samples for OIT measurement can be cut and tested at intervals over a period of 18 hours. This period of time approximately matches the time a new splice might be open to the air.

In particular, the test can be performed on commercially available Differential Scanning Calorimeters (DSC). Degreased aluminum pans should be used for all testing. Copper pans and metal mesh screens should not be used in the test method. Particular care should be taken to calibrate the temperature scale of the DSC instrument and to ensure that the samples were tested at the specific temperature of 200°±0.3° C. Calculation procedures to determine the onset point of the major exothermic oxidation reaction by the standard tangent method may be performed. The cable components will ideally have a minimum oxidative induction time of 20 minutes when tested at 200°±1° C. (392°±2° F.).

Specifically, a section of a single cable approximately three (3) feet long can be used for all testing. It can be cut into three (3) sections and separated. The first 12 inches will be designated as the base wire insulation. This section could supply approximately 4 samples. The second and third sections can be folded in half and a loop can be twisted in the center as shown in FIG. 1. This loop will not be treated with the cleaning composition and can supply an additional base wire insulation sample. One leg of the loop can provide a base sample and then the legs of the loop can be wiped with either an inventive solvent or control solvent. The entire length of the wire can be used with the exception to the cut ends after wiping with either an inventive cleaner or a control cleaner. This procedure will prevent cleaner from being drawn into the foam portion of the insulation. The entire test period will take approximately 84 hours with the last test sample ideally taken at 76 hours into the run and the last control sample taken at 78 hours into the run. OIT values will have a range of ±2 minutes.

It is expected that the Oxidative Induction Time of the cable or cable components cleaned with the inventive compositions will not be significantly reduced and will remain substantially the same as untreated cable. For example, if untreated cable has an OIT value of 43±2 minutes, it is expected that the cable or cable components cleaned with the invention compositions will have an OIT value of from 41±2 to 45±2 minutes.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above compositions without departing from the scope of the invention, it is intended that all matters contained in the foregoing description shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A composition, especially useful for cleaning an insulated telecommunication cable having a known oxidative induction time, comprising:

a solvent;

a nonvolatile preservative oil; and an antioxidant whereby the oxidative induction time of the cable is essentially the same after cleaning with the composition as that prior to cleaning.

2. The water insoluble cleaning composition for cleaning insulated telecommunication cables according to claim 1, wherein the solvent is selected from the group consisting of aliphatic solvents, aromatic solvents, terpene hydrocarbons, aliphatic ketones, cyclic ketones, ester solvents, chlorinated solvents and mixtures thereof.

3. The water insoluble cleaning composition for cleaning insulated telecommunication cables according to claim 1, wherein the nonvolatile preservative oil is selected from the group consisting of polybutene oil and mineral oil.

4. The water insoluble cleaning composition for cleaning insulated telecommunication cables according to claim 1, wherein the antioxidant is selected from the group consisting of 3,4-dihydro-2-methyl-2-(4,8,12-trimethyltridecyl)-2H-1-benzopyran-6-ol, 2-methyl-2-(4,8,12-trimethyltridecyl)-6-chromanol, thio-diethylene-bis-(3,5-di-tert-butyl-4-hydroxyhydrocinnamate), 2-methyl-2-phytyl-6-chromanol, 6-hydroxy-2-methyl-2-phytylchroman and 2-methyl-2-phytyl-6-hydroxychroman.

5. A method of cleaning and preserving an insulated telecommunication cable having a known oxidative induction time which comprises:

a) applying to the cable to be cleaned a composition comprising i) a solvent;

ii) a nonvolatile preservative oil; and iii) an antioxidant; and b) removing any contaminated composition by rinsing the cable with additional composition whereby a residual film of nonvolatile preservative oil remains on the cleaned cable and the oxidative induction time of the cable is essentially the same after cleaning with the composition as that prior to cleaning.

6. The method of cleaning and preserving insulated telecommunication cables according to claim 5, wherein the solvent is selected from the group consisting of aliphatic solvents, aromatic solvents, terpene hydrocarbons, aliphatic ketones, cyclic ketones, ester solvents, chlorinated solvents and mixtures thereof.

7. The method of cleaning and preserving insulated telecommunication cables according to claim 5, wherein the nonvolatile preservative oil is selected from the group consisting of polybutene oil and mineral oil.

8. The method of cleaning and preserving insulated telecommunication cables according to claim 5, wherein the antioxidant is selected from the group consisting of 3,4-dihydro-2-methyl-2-(4,8,12-trimethyltridecyl)-2H-1-benzopyran-6-ol, 2-methyl-2-(4,8,12-trimethyltridecyl)-6-chromanol, thio-diethylene-bis-(3,5-di-tert-butyl-4-hydroxyhydrocinnamate), 2-methyl-2-phytyl-6-chromanol, 6-hydroxy-2-methyl-2-phytylchroman and 2-methyl-2-phytyl-6-hydroxychroman.

* * * * *